US010754268B1

(12) United States Patent
Furuta et al.

(10) Patent No.: US 10,754,268 B1
(45) Date of Patent: Aug. 25, 2020

(54) TONER FOR ELECTROSTATIC IMAGE DEVELOPMENT, ELECTROSTATIC IMAGE DEVELOPER, AND TONER CARTRIDGE

(71) Applicant: FUJI XEROX CO, LTD., Tokyo (JP)

(72) Inventors: Tsutomu Furuta, Kanagawa (JP); Masaru Takahashi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/516,964

(22) Filed: Jul. 19, 2019

(30) Foreign Application Priority Data

Mar. 8, 2019 (JP) ..... 2019-042914

(51) Int. Cl.

| | |
|---|---|
| ***G03G 9/08*** | (2006.01) |
| ***G03G 9/087*** | (2006.01) |
| ***G03G 15/08*** | (2006.01) |
| ***G03G 9/093*** | (2006.01) |
| ***G03G 9/09*** | (2006.01) |

(52) U.S. Cl.
CPC ..... *G03G 9/08755* (2013.01); *G03G 9/0819* (2013.01); *G03G 9/0821* (2013.01); *G03G 9/08711* (2013.01); *G03G 9/092* (2013.01); *G03G 9/093* (2013.01); *G03G 9/0906* (2013.01); *G03G 9/0918* (2013.01); *G03G 15/0865* (2013.01)

(58) Field of Classification Search
CPC ..... G03G 9/0821
USPC ..... 430/111.4
See application file for complete search history.

(56) References Cited

U.S. PATENT DOCUMENTS

2014/0023967 A1* 1/2014 Kabata ..... G03G 13/22 430/124.13

FOREIGN PATENT DOCUMENTS

| | | |
|---|---|---|
| CN | 104536275 A | 4/2015 |
| JP | 2015-184481 A | 10/2015 |

OTHER PUBLICATIONS

"Testing Methods for Transition Temperatures of plastics", Japanese Industrial Standard, JIS K 7121-1987, Japanese Standards Association, Oct. 1, 1987, 26 pages.

* cited by examiner

*Primary Examiner* — Mark A Chapman
(74) *Attorney, Agent, or Firm* — Sughrue Mion, PLLC

(57) ABSTRACT

A toner for electrostatic image development includes: a binder resin; and a coloring agent. When an image with a toner mass per unit area of 4.0 g/m$^2$ is formed using the toner, the image has a color that satisfies the following conditions (A), (B), and (C):

(A) L* is from 37 to 50 inclusive;
(B) a* is from −12 to 8 inclusive; and
(C) b* is from −49 to −40 inclusive.

19 Claims, 2 Drawing Sheets

TONER FOR ELECTROSTATIC IMAGE DEVELOPMENT, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2019-042914 filed Mar. 8, 2019.

BACKGROUND

(i) Technical Field

The present disclosure relates to a toner for electrostatic image development, to an electrostatic image developer, and to a toner cartridge.

(ii) Related Art

Visualization methods such as an electrophotographic method which visualize image information through electrostatic images are currently used in various fields.

In a conventional electrophotographic method commonly used, image information is visualized through the steps of: forming electrostatic latent images on photoconductors or electrostatic recording mediums using various means; causing electroscopic particles referred to as toner to adhere to the electrostatic latent images to develop the electrostatic latent images (toner images); transferring the developed images onto the surface of a transfer body; and fixing the images by, for example, heating.

Known conventional toners are disclosed in Chinese published patent application No. 104536275 and Japanese Unexamined Patent Application Publication No. 2015-184481.

Chinese published patent application No. 104536275 discloses a toner containing 60% to 80% of a polyester resin, 10% to 30% of a styrene acrylic resin, 1% to 10 of a cyan pigment, 0.1% to 4% of a magenta (red) pigment, 2% to 5% of a release agent, and 1% to 3% of a charge control agent. The polyester resin has a Tg of 40° C. to 55° C. and a softening temperature T½ of 80° C. to 110° C., and the styrene acrylic resin has a Tg of 50° C. to 70° C. and a softening temperature T½ of 120° C. to 140° C.

Japanese Unexamined Patent Application Publication No. 2015-184481 discloses a toner for a single color copier. The toner contains at least a binder resin and a coloring agent. The coloring agent contains a cyan pigment and a magenta pigment, and the color of an image printed with the toner satisfies conditions (A) to (C) below. In the dynamic viscoelasticity characteristics of the toner, the storage modulus G' at 110° C. is from 25,000 Pa to 55,000 Pa inclusive, and the storage modulus G' at 180° C. is from 550 Pa to 1,100 Pa inclusive.

(A) L* is from 28 to 36 inclusive.
(B) a* is from 9 to 23 inclusive.
(C) b* is from −53 to −34 inclusive.

SUMMARY

Aspects of non-limiting embodiments of the present disclosure relate to a toner for electrostatic image development. When an image with a toner mass per unit area of 4.0 g/m$^2$ is formed using the toner, the outdoor visibility of the image obtained is better than that of an image having a color with an L* of less than 37 or more than 50, an a* of less than −12 or more than 8, or a b* of less than −49 or more than −40.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner for electrostatic image development containing a binder resin and a coloring agent, wherein, when an image with a toner mass per unit area of 4.0 g/m$^2$ is formed using the toner, the image has a color that satisfies the following conditions (A), (B), and (C):

(A) L* is from 37 to 50 inclusive;
(B) a* is from −12 to 8 inclusive; and
(C) b* is from −49 to −40 inclusive.

BRIEF DESCRIPTION OF THE DRAWINGS

Exemplary embodiments of the present disclosure will be described in detail based on the following figures, wherein.

DETAILED DESCRIPTION

Figure 1:
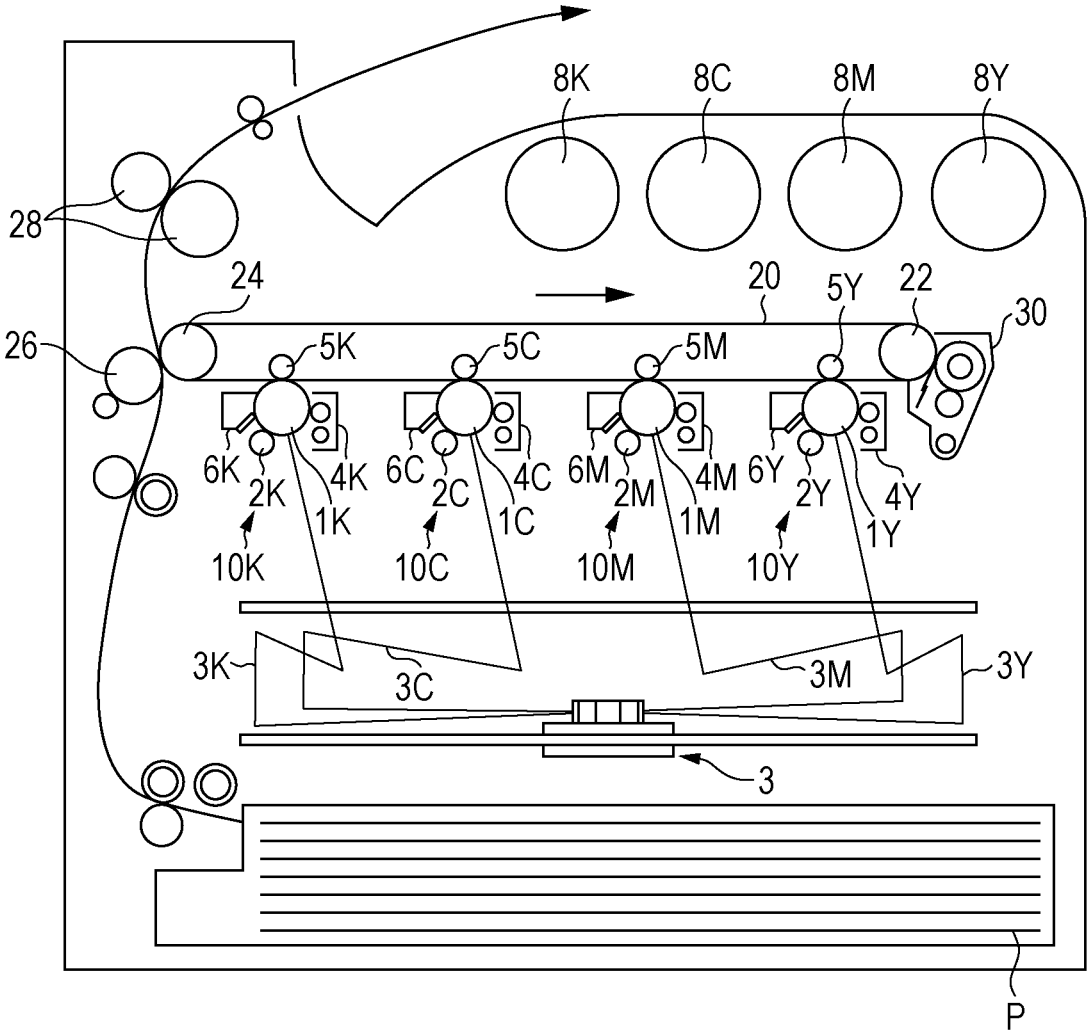
FIG. 1 is a schematic configuration diagram showing an image forming apparatus according to an exemplary embodiment.

In exemplary embodiments of the disclosure, when reference is made to the amount of a component in a composition, if the composition contains a plurality of materials corresponding to the above component, the above amount means the total amount of the plurality of materials, unless otherwise specified.

In the exemplary embodiments of the disclosure, the "toner for electrostatic image development" may be referred to simply as a "toner," and the "electrostatic image developer" may be referred to simply as a "developer."

The exemplary embodiments of the present disclosure will be described.

<Toner for Electrostatic Image Development>

A toner for electrostatic image development according to an exemplary embodiment contains: a binder resin; and a coloring agent, wherein, when an image with a toner mass per unit area of 4.0 g/m$^2$ is formed using the toner, the image has a color that satisfies the following conditions (A), (B), and (C):

(A) L* is from 37 to 50 inclusive;
(B) a* is from −12 to 8 inclusive; and
(C) b* is from −49 to −40 inclusive.

The toner for electrostatic image development according to the present exemplary embodiment may be suitably used as a blue toner.

Conventional diazo (blueprint) copiers have been used for printing large format drawings because of their high dimensional accuracy and low running cost. However, the diazo copiers use ammonia and dedicated photosensitive paper sheets. Because of recent progress in electrophotographic technology, electrophotographic copiers are mainly used to print large format drawings. Although blueprint-like images (blue color prints) are often demanded, the outdoor visibility of such images is insufficient.

By setting the L*a*b* values of the color within the above-described ranges that differ from conventional ranges, more specifically, by setting the L* value to a higher value and the a* value to a lower value, an image with better outdoor visibility is obtained.

The toner for electrostatic image development according to the present exemplary embodiment will be described in detail.

(Color of Image with Toner Mass Per Unit Area of 4.0 g/m$^2$)

When the toner for electrostatic image development according to the present exemplary embodiment is used to form an image with a toner mass per unit area of 4.0 g/m$^2$, the color of the image satisfies the conditions (A), (B), and (C) described above.

In the present exemplary embodiment, the color of the image formed with a toner mass per unit area of 4.0 g/m$^2$ is measured as follows.

A white paper sheet (paper thickness: 88 μm, basis weight: 64 g/m$^2$) is used. The toner is filled into an image forming apparatus (obtained by modifying ApeosPort-II4300 manufactured by Fuji Xerox Co., Ltd.), and the toner mass per unit area on the sheet is set to 4.0 g/m$^2$. A fixed image with a toner mass per unit area of 4.0 g/m$^2$ is formed on the sheet, and the L*, a*, and b* values in the CIE 1976 L*a*b* color space are determined as the color of the fixed image using X-rite 938 (manufactured by X-rite).

When the image with a toner mass per unit area of 4.0 g/m$^2$ is formed using the toner for electrostatic image development according to the present exemplary embodiment, the L* value of the image is preferably from 38 to 48 inclusive, more preferably from 39 to 46 inclusive, and particularly preferably from 40 to 43 inclusive, from the viewpoint of the outdoor visibility of the image formed.

When the image with a toner mass per unit area of 4.0 g/m$^2$ is formed using the toner for electrostatic image development according to the present exemplary embodiment, the a* value of the image is preferably from −7 to 5 inclusive, more preferably from −4 to 3 inclusive, and particularly preferably from −2 to 0 inclusive, from the viewpoint of the outdoor visibility of the image formed.

When the image with a toner mass per unit area of 4.0 g/m$^2$ is formed using the toner for electrostatic image development according to the present exemplary embodiment, the b* value of the image is preferably from −48 to −42 inclusive, more preferably from −47 to −43 inclusive, and particularly preferably from −46 to −44 inclusive, from the viewpoint of the outdoor visibility of the image formed.

When the image with a toner mass per unit area of 4.0 g/m$^2$ is formed using the toner for electrostatic image development according to the present exemplary embodiment, the image has preferably a color with an L* of from 38 to 48 inclusive,
an a* of from −7 to 5 inclusive, and
a b* of from −48 to −42 inclusive,
more preferably a color with
an L* of from 39 to 46 inclusive,
an a* of from −4 to 3 inclusive, and
a b* of from −47 to −43 inclusive, and
particularly preferably a color with
an L* of from 40 to 43 inclusive,
an a* of from −2 to 0 inclusive, and
a b* of from −46 to −44 inclusive, from the viewpoint of the outdoor visibility of the image formed.

(Color Difference ΔE Between Image Obtained and PANTONE 2935U Used as Color Sample)

With the toner for electrostatic image development according to the present exemplary embodiment, the color difference ΔE between the image with a toner mass per unit area of 4.0 g/m$^2$ and PANTONE 2935U used as a color sample is preferably 7 or less, more preferably 5 or less, and particularly preferably 3 or less, from the viewpoint of the outdoor visibility of the image formed.

The color difference ΔE is a value determined using the following formula.

$$\Delta E=\{(L^*_p-L^*)^2+(a^*_p-a^*)^2+(b^*_p-b^*)^2\}^{0.5}$$

Here, L*, a*, and b* represent the color of the image with a toner mass per unit area of 4.0 g/m$^2$, and $L^*_p$, $a^*_p$, and $b^*_p$ represent the color of the color sample PANTONE 2935U that is measured as the L*, a*, and b* values in the L*a*b* color space using X-rite 938 (manufactured by X-rite).

The toner according to the present exemplary embodiment is configured to include toner particles (which may be referred to also as "toner base particles") and an optional external additive.

(Toner Particles)

The toner particles contain, for example, a binder resin and a coloring agent and optionally contain a release agent and additional additives. The toner particles may contain a binder resin, a coloring agent, and a release agent.

—Coloring Agent—

No particular limitation is imposed on the coloring agent so long as, when the toner for electrostatic image development is used to form an image with a toner mass per unit area of 4.0 g/m$^2$, the color of the image satisfies the conditions (A), (B), and (C) described above. From the viewpoint of the outdoor visibility of the image formed, it is preferable that the coloring agent contains at least one pigment selected from the group consisting of cyan pigments and magenta pigments, and it is more preferable that the coloring agent contains a cyan pigment and a magenta pigment.

The cyan pigment used may be a well-known pigment, and specific examples include aniline blue and phthalocyanine blue.

In particular, from the viewpoint of the outdoor visibility of the image formed, it is preferable that the cyan pigment contains a copper phthalocyanine-based pigment, and it is more preferable that the cyan pigment contains C.I. (Color Index) Pigment Blue 15:3. It is particularly preferable that the cyan pigment contains C.I. Pigment Blue 15:3 in an amount of 80% by mass or more based on the total mass of the cyan pigment.

The magenta pigment used may be a well-known pigment, and specific examples include quinacridone-based pigments, carmine-based pigments, monoazo-based pigments typified by naphthol-based pigments, condensed azo-based pigments such as Chromophthal Red, and triarylmethane-based pigments.

In particular, from the viewpoint of the outdoor visibility of the image formed, it is preferable that the magenta pigment contains at least one pigment selected from the group consisting of quinacridone-based pigments, carmine-based pigments, and naphthol-based pigments, and it is more preferable that the magenta pigment contains a naphthol-based pigment. It is still more preferable that the magenta pigment contains C.I. Pigment Red 238, and it is particularly preferable that the magenta pigment contains C.I. Pigment Red 238 in an amount of 80% by mass or more based on the total mass of the magenta pigment.

From the viewpoint of the outdoor visibility of the image formed, the ratio ($W^M/W^C$) of the content $W^M$ of the magenta pigment in the toner for electrostatic image development to the content $M^C$ of the cyan pigment in the toner is preferably from 0.40 to 1.10 inclusive, more preferably 0.50 or more and less than 1.00, still more preferably from 0.55 to 0.85 inclusive, and particularly preferably from 0.60 to 0.80 inclusive.

The coloring agent used may contain an additional coloring agent other than the cyan pigment and the magenta pigment, and the additional coloring agent may be a well-known coloring agent.

From the viewpoint of the outdoor visibility of the image formed, the content of the additional coloring agent in the toner for electrostatic image development is preferably less than the content of the cyan pigment and less than the content of the magenta pigment, more preferably less than 20% of the content of the cyan pigment and less than 20% of the content of the magenta pigment, and still more preferably less than 10% of the content of the cyan pigment and less than 10% of the content of the magenta pigment. Particularly preferably, the coloring agent contains no additional coloring agent.

Any of these coloring agents may be used alone or in combination of two or more.

The coloring agent used may be optionally subjected to surface treatment or may be used in combination with a dispersant.

The content of the coloring agent is preferably from 1% by mass to 30% by mass inclusive and more preferably from 3% by mass to 15% by mass inclusive based on the total mass of the toner particles.

The content of the cyan pigment is preferably from 2.0% by mass to 5.0% by mass inclusive, more preferably from 2.9% by mass to 4.3% by mass inclusive, and particularly preferably from 3.2% by mass to 4.0% by mass inclusive based on the total mass of the toner for electrostatic image development.

The content of the magenta pigment is preferably from 0.5% by mass to 5.0% by mass inclusive, more preferably from 1.5% by mass to 3.5% by mass inclusive, and particularly preferably from 2.0% by mass to 3.0% by mass inclusive based on the total mass of the toner for electrostatic image development.

—Binder Resin—

Examples of the binder resin include: vinyl resins composed of homopolymers of monomers such as styrenes (such as styrene, p-chlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl resins; and graft polymers obtained by polymerizing a vinyl monomer in the presence of any of these resins.

Of these, styrene acrylic resins and polyester resins are preferably used, and polyester resins are more preferably used.

Any of these binder resins may be used alone or in combination of two or more.

The binder resin may be an amorphous (non-crystalline) resin or a crystalline resin.

From the viewpoint of the image intensity of fine lines, it is preferable that the binder resin contains a crystalline resin, and it is more preferable that the binder resin contains an amorphous resin and a crystalline resin.

The content of the crystalline resin is preferably from 2% by mass to 30% by mass inclusive and more preferably from 5% by mass to 20% by mass inclusive based on the total mass of the binder resin.

The "crystalline" resin means that, in differential scanning calorimetry (DSC), a clear endothermic peak is observed instead of a stepwise change in the amount of heat absorbed. Specifically, the half width of the endothermic peak when the measurement is performed at a heating rate of 10 (° C./min) is 15° C. or less.

The "amorphous" resin means that the half width exceeds 15° C., that a stepwise change in the amount of heat absorbed is observed, or that a clear endothermic peak is not observed.

The polyester resin may be, for example, a well-known polyester resin.

The polyester resin used may be a combination of an amorphous polyester resin and a crystalline polyester resin. The content of the crystalline polyester resin is preferably from 2% by mass to 30% by mass inclusive and more preferably from 5% by mass to 20% by mass inclusive based on the total mass of the binder resin.

Amorphous Polyester Resin

The amorphous polyester resin may be, for example, a polycondensation product of a polycarboxylic acid and a polyhydric alcohol. The amorphous polyester resin used may be a commercial product or a synthesized product.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl (e.g., having 1 to 5 carbon atoms) esters thereof. In particular, the polycarboxylic acid is, for example, preferably an aromatic dicarboxylic acid.

The polycarboxylic acid used may be a combination of a dicarboxylic acid and a tricarboxylic or higher polycarboxylic acid having a crosslinked or branched structure. Examples of the tricarboxylic or higher polycarboxylic acid include trimellitic acid, pyromellitic acid, anhydrides thereof, and lower alkyl (e.g., having 1 to 5 carbon atoms) esters thereof.

Any of these polycarboxylic acids may be used alone or in combination of two or more.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). In particular, the polyhydric alcohol is, for example, preferably an aromatic diol or an alicyclic diol and more preferably an aromatic diol.

The polyhydric alcohol used may be a combination of a diol and a trihydric or higher polyhydric alcohol having a crosslinked or branched structure. Examples of the trihydric or higher polyhydric alcohol include glycerin, trimethylolpropane, and pentaerythritol.

Any of these polyhydric alcohols may be used alone or in combination or two or more.

The glass transition temperature (Tg) of the amorphous polyester resin is preferably from 50° C. to 80° C. inclusive and more preferably from 50° C. to 65° C. inclusive.

The glass transition temperature is determined from a DSC curve obtained by differential scanning calorimetry (DSC). More specifically, the glass transition temperature is determined from "extrapolated glass transition onset temperature" described in glass transition temperature determination methods in "Testing methods for transition temperatures of plastics" in JIS K7121-1987.

The weight average molecular weight (Mw) of the amorphous polyester resin is preferably from 5,000 to 1,000,000 inclusive and more preferably from 7,000 to 500,000 inclusive.

The number average molecular weight (Mn) of the amorphous polyester resin may be from 2,000 to 100,000 inclusive.

The molecular weight distribution Mw/Mn of the amorphous polyester resin is preferably from 1.5 to 100 inclusive and more preferably from 2 to 60 inclusive.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The amorphous polyester resin can be obtained by a well-known production method. For example, in one production method, the polymerization temperature is set to from 180° C. to 230° C. inclusive. If necessary, the pressure of the reaction system is reduced, and the reaction is allowed to proceed while water and alcohol generated during condensation are removed.

When raw material monomers are not dissolved or not compatible with each other at the reaction temperature, a high-boiling point solvent serving as a solubilizer may be added to dissolve the monomers. In this case, the polycondensation reaction is performed while the solubilizer is removed by evaporation. When a monomer with poor compatibility is present, the monomer with poor compatibility and an acid or an alcohol to be polycondensed with the monomer are condensed in advance and then the resulting polycondensation product and the rest of the components are subjected to polycondensation.

Crystalline Polyester Resin

The crystalline polyester resin is, for example, a polycondensation product of a polycarboxylic acid and a polyhydric alcohol. The crystalline polyester resin used may be a commercial product or a synthesized product.

The crystalline polyester resin is preferably a polycondensation product using a polymerizable monomer having a linear aliphatic group rather than using a polymerizable monomer having an aromatic group, in order to facilitate the formation of a crystalline structure.

Examples of the polycarboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (such as dibasic acids such as phthalic acid, isophthalic acid, terephthalic acid, and naphthalene-2,6-dicarboxylic acid), anhydrides thereof, and lower alkyl (e.g., having 1 to 5 carbon atoms) esters thereof.

The polycarboxylic acid used may be a combination of a dicarboxylic acid and a tricarboxylic or higher polycarboxylic acid having a crosslinked or branched structure. Examples of the tricarboxylic acid include aromatic carboxylic acids (such as 1,2,3-benzenetricarboxylic acid, 1,2,4-benzenetricarboxylic acid, and 1,2,4-naphthalene tricarboxylic acid), anhydrides thereof, and lower alkyl (e.g., having 1 to 5 carbon atoms) esters thereof.

The polycarboxylic acid used may be a combination of a dicarboxylic acid, a dicarboxylic acid having a sulfonic acid group, and a dicarboxylic acid having an ethylenic double bond.

Any of these polycarboxylic acids may be used alone or in combination of two or more.

The polyhydric alcohol may be, for example, an aliphatic diol (e.g., a linear aliphatic diol with a main chain having 7 to 20 carbon atoms). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. In particular, the aliphatic diol is preferably 1,8-octanediol, 1,9-nonanediol, or 1,10-decanediol.

The polyhydric alcohol used may be a combination of a diol and a trihydric or higher polyhydric alcohol having a crosslinked or branched structure. Examples of the trihydric or higher polyhydric alcohol include glycerin, trimethylolethane, trimethylolpropane, and pentaerythritol.

Any of these polyhydric alcohols may be used alone or in combination of two or more.

In the polyhydric alcohol, the content of the aliphatic diol may be 80% by mole or more and preferably 90% by mole or more.

The melting temperature of the crystalline polyester resin is preferably from 50° C. to 100° C. inclusive, more preferably from 55° C. to 90° C. inclusive, and still more preferably from 60° C. to 85° C. inclusive.

The melting temperature is determined using a DCS curve obtained by differential scanning calorimetry (DSC) from "peak melting temperature" described in melting temperature determination methods in "Testing methods for transition temperatures of plastics" in JIS K7121-1987.

The weight average molecular weight (Mw) of the crystalline polyester resin may be from 6,000 to 35,000 inclusive.

Like the amorphous polyester, the crystalline polyester resin is obtained by a well-known production method.

From the viewpoint of the scratch resistance of images, the weight average molecular weight (Mw) of the binder resin is preferably from 5,000 to 1,000,000 inclusive, more preferably from 7,000 to 500,000 inclusive, and particularly preferably from 25,000 to 60,000 inclusive. The number average molecular weight (Mn) of the binder resin is preferably from 2,000 to 100,000 inclusive. The molecular weight distribution Mw/Mn of the binder resin is preferably from 1.5 to 100 inclusive and more preferably from 2 to 60 inclusive.

The weight average molecular weight and number average molecular weight of the binder resin are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The content of the binder resin is preferably from 40% by mass to 95% by mass inclusive, more preferably from 50% by mass to 90% by mass inclusive, and still more preferably from 60% by mass to 85% by mass inclusive based on the total mass of the toner particles.

—Release Agent—

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the release agent is not limited to these waxes.

The melting temperature of the release agent is preferably from 50° C. to 110° C. inclusive and more preferably from 60° C. to 100° C. inclusive.

The melting temperature is determined using a DCS curve obtained by differential scanning calorimetry (DSC) from "peak melting temperature" described in melting temperature determination methods in "Testing methods for transition temperatures of plastics" in JIS K7121-1987.

The content of the release agent is preferably from 1% by mass to 20% by mass inclusive and more preferably from 5% by mass to 15% by mass inclusive based on the total mass of the toner particles.

—Additional Additives—

Examples of additional additives include well-known additives such as a magnetic material, a charge control agent, and an inorganic powder. These additives are contained in the toner particles as internal additives.

—Characteristics Etc. Of Toner Particles—

The toner particles may have a single layer structure or may be core-shell particles each having a so-called core-shell structure including a core (core particle) and a coating layer (shell layer) covering the core. The toner particles having the core-shell structure may each include, for example: a core containing the binder resin and optional additives such as the coloring agent and the release agent; and a coating layer containing the binder resin.

From the viewpoint of the outdoor visibility of the image formed, the volume average particle diameter ($D_{50v}$) of the toner is preferably 3.5 μm or more and less than 8.0 μm, more preferably from 4.0 μm to 7.5 μm inclusive, and particularly preferably from 4.5 μm to 7.0 μm inclusive.

The volume average particle diameter of the toner is measured using Coulter Multisizer II (manufactured by Beckman Coulter, Inc.), and ISOTON-II (manufactured by Beckman Coulter, Inc.) is used as an electrolyte.

In the measurement, 0.5 mg to 50 mg of a measurement sample is added to 2 mL of a 5% by mass aqueous solution of a surfactant (preferably sodium alkylbenzenesulfonate) serving as a dispersant. The mixture is added to 100 mL to 150 mL of the electrolyte.

The electrolyte with the sample suspended therein is subjected to dispersion treatment for 1 minute using an ultrasonic dispersion apparatus, and then the diameters of particles within the range of 2 μm to 60 μm are measured using the Coulter Multisizer II with an aperture having an aperture diameter of 100 μm. The number of particles sampled is 50,000.

The particle diameters measured are used to obtain a volumetric cumulative distribution computed from the small diameter side, and the particle diameter at a cumulative frequency of 50% is defined as the volume average particle diameter $D_{50v}$.

In the present exemplary embodiment, no particular limitation is imposed on the average circularity of the toner particles. However, from the viewpoint of improving the ease of cleaning the toner from an image-holding member, the average circularity is preferably from 0.91 to 0.98 inclusive, more preferably from 0.94 to 0.98 inclusive, and still more preferably from 0.95 to 0.97 inclusive.

In the present exemplary embodiment, the circularity of a toner particle is (the peripheral length of a circle having the same area as a projection image of the particle/the peripheral length of the projection image of the particle). The average circularity of the toner particles is the circularity when a cumulative frequency computed from the small diameter side in the circularity distribution is 50%. The average circularity of the toner particles is determined by analyzing at least 3,000 toner particles using a flow-type particle image analyzer.

When the toner particles are produced, for example, by an aggregation/coalescence method, the average circularity of the toner particles can be controlled by adjusting the stirring rate of a dispersion, the temperature of the dispersion, or the retention time in a fusion/coalescence step.

(External Additive)

Examples of the external additive include inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the external additive may be subjected to hydrophobic treatment. The hydrophobic treatment is performed, for example, by immersing the inorganic particles in a hydrophobic treatment agent. No particular limitation is imposed on the hydrophobic treatment agent, and examples of the hydrophobic treatment agent include silane-based coupling agents, silicone oils, titanate-based coupling agents, and aluminum-based coupling agents. Any of these may be used alone or in combination of two or more.

The amount of the hydrophobic treatment agent may be, for example, from 1 part by mass to 10 parts by mass based on 100 parts by mass of the inorganic particles.

Other examples of the external additive include resin particles (particles of resins such as polystyrene, polymethyl methacrylate (PMMA), and melamine resins) and cleaning activators (such as metal salts of higher fatty acids typified by zinc stearate and fluorine-based polymer particles).

The amount of the external additive added externally is, for example, preferably from 0.01% by mass to 10% by mass inclusive and more preferably from 0.01% by mass to 6% by mass inclusive based on the mass of the toner particles.

[Method for Producing Toner]

Next, a method for producing the toner according to the present exemplary embodiment will be described.

The toner according to the present exemplary embodiment is obtained by producing toner particles and then externally adding the external additive to the toner particles produced.

The toner particles may be produced by a dry production method (such as a kneading-grinding method) or by a wet production method (such as an aggregation/coalescence method, a suspension polymerization method, or a dissolution/suspension method). No particular limitation is imposed on the production method, and any known production method may be used. In particular, the aggregation/coalescence method may be used to obtain the toner particles.

Specifically, when the toner particles are produced, for example, by the aggregation/coalescence method, the toner particles are produced through: the step of preparing a resin particle dispersion in which resin particles used as the binder resin are dispersed (a resin particle dispersion preparing step); the step of aggregating the resin particles (and other optional particles) in the resin particle dispersion (the dispersion may optionally contain an additional particle dispersion mixed therein) to form aggregated particles (an aggregated particle forming step); and the step of heating the aggregated particle dispersion with the aggregated particles dispersed therein to fuse and coalesce the aggregated particles to thereby form the toner particles (a fusion/coalescence step).

These steps will next be described in detail.

In the following, a method for obtaining toner particles containing the coloring agent and the release agent will be described, but the coloring agent and the release agent are used optionally. Of course, additional additives other than the coloring agent and the release agent may be used.

—Resin Particle Dispersion Preparing Step—

The resin particle dispersion in which the resin particles used as the binder resin are dispersed is prepared, and, for example, a coloring agent particle dispersion in which coloring agent particles are dispersed and a release agent particle dispersion in which release agent particles are dispersed are prepared.

The resin particle dispersion is prepared, for example, by dispersing the resin particles in a dispersion medium using a surfactant.

Examples of the dispersion medium used for the resin particle dispersion include aqueous mediums.

Examples of the aqueous medium include: water such as distilled water and ion exchanged water; and alcohols. Any of these may be used alone or in combination of two or more.

Examples of the surfactant include: anionic surfactants such as sulfate-based surfactants, sulfonate-based surfactants, phosphate-based surfactants, and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants, and polyhydric alcohol-based surfactants. Of these, an anionic surfactant or a cationic surfactant may be used. A nonionic surfactant may be used in combination with the anionic surfactant or the cationic surfactant.

Any of these surfactants may be used alone or in combination of two or more.

To disperse the resin particles in the dispersion medium to form the resin particle dispersion, a commonly used dispersing method that uses, for example, a rotary shearing-type homogenizer, a ball mill using media, a sand mill, or a dyno-mill may be used. The resin particles may be dispersed in the dispersion medium by a phase inversion emulsification method, but this depends on the type of resin particles. In the phase inversion emulsification method, the resin to be dispersed is dissolved in a hydrophobic organic solvent that can dissolve the resin, and a base is added to an organic continuous phase (O phase) to neutralize it. Then the aqueous medium (W phase) is added to perform phase inversion from W/O to O/W, and the resin is thereby dispersed as particles in the aqueous medium.

The volume average particle diameter of the resin particles dispersed in the resin particle dispersion is, for example, preferably from 0.01 μm to 1 μm inclusive, more preferably from 0.08 μm to 0.8 μm inclusive, and still more preferably from 0.1 μm to 0.6 μm inclusive.

The volume average particle diameter of the resin particles is measured as follows. A particle size distribution measured by a laser diffraction particle size measurement apparatus (e.g., LA-700 manufactured by HORIBA Ltd.) is used and divided into different particle diameter ranges (channels), and a cumulative volume distribution computed from the small particle diameter side is determined. The particle diameter at which the cumulative frequency is 50% is measured as the volume average particle diameter $D_{50v}$. The volume average particle diameters of particles in other dispersions are measured in the same manner.

The content of the resin particles contained in the resin particle dispersion is preferably from 5% by mass to 50% by mass inclusive and more preferably from 10% by mass to 40% by mass inclusive.

For example, the coloring agent particle dispersion and the release agent particle dispersion are prepared in a similar manner to the resin particle dispersion. Specifically, the descriptions of the volume average particle diameter of the particles in the resin particle dispersion, the dispersion medium for the resin particle dispersion, the dispersing method, and the content of the resin particles are applicable to the coloring agent particles dispersed in the coloring agent particle dispersion and the release agent particles dispersed in the release agent particle dispersion.

—Aggregated Particle Forming Step—

Next, the resin particle dispersion, the coloring agent particle dispersion, and the release agent particle dispersion are mixed. Then the resin particles, the coloring agent particles, and the release agent particles are hetero-aggregated in the dispersion mixture to form aggregated particles containing the resin particles, the coloring agent particles, and the release agent particles and having diameters close to the diameters of target toner particles.

Specifically, for example, a flocculant is added to the dispersion mixture, and the pH of the dispersion mixture is adjusted to acidic (for example, a pH of from 2 to 5 inclusive). Then a dispersion stabilizer is optionally added, and the resulting mixture is heated to a temperature close to the glass transition temperature of the resin particles (specifically, for example, a temperature from the glass transition temperature of the resin particles −30° C. to the glass transition temperature −10° C. inclusive) to aggregate the particles dispersed in the dispersion mixture to thereby form aggregated particles.

In the aggregated particle forming step, for example, while the dispersion mixture is agitated in a rotary shearing-type homogenizer, the flocculant is added at room temperature (e.g., 25° C.), and the pH of the dispersion mixture is adjusted to acidic (e.g., a pH of from 2 to 5 inclusive). The dispersion stabilizer may be optionally added, and the resulting mixture may be heated.

Examples of the flocculant include a surfactant with polarity opposite to the polarity of the surfactant contained in the dispersion mixture, inorganic metal salts, and divalent or higher polyvalent metal complexes. When a metal complex is used as the flocculant, the amount of the surfactant used can be reduced, and charging characteristics are improved.

An additive that forms a complex with a metal ion in the flocculant or a similar bond may be optionally used together with the flocculant. The additive used may be a chelating agent.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent used may be a water-soluble chelating agent. Examples of the chelating agent include: oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of the flocculant added is preferably from 0.01 parts by mass to 5.0 parts by mass inclusive and more preferably 0.1 parts by mass or more and less than 3.0 parts by mass based on 100 parts by mass of the resin particles.

—Fusion/Coalescence Step—

Next, the aggregated particle dispersion in which the aggregated particles are dispersed is heated, for example, to a temperature equal to or higher than the glass transition temperature of the resin particles (e.g., a temperature higher by 30° C. to 50° C. than the glass transition temperature of the resin particles) and equal to or higher than the melting temperature of the release agent to fuse and coalesce the aggregated particles to thereby form toner particles.

In the fusion/coalescence step, the resin and the release agent are compatible with each other at the temperature equal to or higher than the glass transition temperature of the resin particles and equal to or higher than the melting temperature of the release agent. Then the dispersion is cooled to obtain a toner.

To control the aspect ratio of the release agent in the toner, the dispersion is held at a temperature around the freezing point of the release agent for a given time during cooling to grow the crystals of the release agent. Alternatively, two or more types of release agents with different melting temperatures are used. In this case, crystal growth during cooling can be facilitated, and the aspect ratio can be controlled.

The toner particles are obtained through the above-described steps.

Alternatively, the toner particles may be produced through: the step of, after the preparation of the aggregated particle dispersion containing the aggregated particles dispersed therein, mixing the aggregated particle dispersion further with the resin particle dispersion containing the resin particles dispersed therein and then causing the resin particles to adhere to the surface of the aggregated particles to aggregate them to thereby form second aggregated particles; and the step of heating a second aggregated particle dispersion containing the second aggregated particles dispersed therein to fuse and coalesce the second aggregated particles to thereby form toner particles having the core-shell structure.

After completion of the fusion/coalescence step, the toner particles formed in the solution are subjected to a well-known washing step, a solid-liquid separation step, and a drying step to obtain dried toner particles. From the viewpoint of chargeability, the toner particles may be subjected to displacement washing with ion exchanged water sufficiently in the washing step. From the viewpoint of productivity, suction filtration, pressure filtration, etc. may be performed in the solid-liquid separation step. From the viewpoint of productivity, freeze-drying, flash drying, fluidized drying, vibrating fluidized drying, etc. may be performed in the drying step.

The toner according to the present exemplary embodiment is produced, for example, by adding the external additive to the dried toner particles obtained and mixing them. The mixing may be performed, for example, using a V blender, a Henschel mixer, a Loedige mixer, etc. If necessary, coarse particles in the toner may be removed using a vibrating sieving machine, an air sieving machine, etc.

<Electrostatic Image Developer>

An electrostatic image developer according to an exemplary embodiment contains at least the toner according to the preceding exemplary embodiment. The electrostatic image developer according to the present exemplary embodiment may be a one-component developer containing only the toner according to the preceding exemplary embodiment or may be a two-component developer containing a mixture of the toner and a carrier.

No particular limitation is imposed on the carrier, and a well-known carrier may be used. Examples of the carrier include: a coated carrier prepared by coating the surface of a core material formed of a magnetic powder with a resin; a magnetic powder-dispersed carrier prepared by dispersing a magnetic powder in a matrix resin; and a resin-impregnated carrier prepared by impregnating a porous magnetic powder with a resin. In each of the magnetic powder-dispersed carrier and the resin-impregnated carrier, the particles included in the carrier may be used as cores, and their surface may be coated with a resin.

Examples of the magnetic powder include: magnetic metal powders such as iron powder, nickel powder, and cobalt powder; and magnetic oxide powders such as ferrite powder and magnetite powder.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins having organosiloxane bonds and modified products thereof, fluorocarbon resins, polyesters, polycarbonates, phenolic resins, and epoxy resins. The coating resin and the matrix resin may contain an additive such as electrically conductive particles. Examples of the electrically conductive particles include: particles of metals such as gold, silver, and copper; and particles of carbon black, titanium oxide, zinc oxide, tin oxide, barium sulfate, aluminum borate, and potassium titanate.

To coat the surface of the core material with a resin, the surface of the core material may be coated with a coating layer-forming solution prepared by dissolving the coating resin and various additives (used optionally) in an appropriate solvent. No particular limitation is imposed on the solvent, and the solvent may be selected in consideration of the type or resin used, ease of coating, etc. Specific examples of the resin coating method include: an immersion method in which the core material is immersed in the coating layer-forming solution; a spray method in which the coating layer-forming solution is sprayed onto the surface of the core material; a fluidized bed method in which the coating layer-forming solution is sprayed onto the core material floated by the flow of air; and a kneader-coater method in which the core material and the coating layer-forming solution are mixed in a kneader coater and then the solvent is removed.

The mixing ratio (mass ratio) of the toner and the carrier in the two-component developer is preferably toner:carrier=1:100 to 30:100 and more preferably 3:100 to 20:100.

<Image Forming Apparatus and Image Forming Method>

An image forming apparatus and an image forming method in an exemplary embodiment will be described.

The image forming apparatus in the present exemplary embodiment includes: an image holding member; charging means for charging the surface of the image holding member; electrostatic image forming means for forming an electrostatic image on the charged surface of the image holding member; developing means that contains an electrostatic image developer and develops the electrostatic image formed on the surface of the image holding member with the electrostatic image developer to thereby form a toner image; transferring means for transferring the toner image formed on the surface of the image holding member onto a recording medium; and fixing means for fixing the toner image transferred onto the recording medium. The electrostatic image developer used is the electrostatic image developer according to the preceding exemplary embodiment.

In the image forming apparatus in the present exemplary embodiment, an image forming method (an image forming method in the present exemplary embodiment) is performed. The image forming method includes: charging the surface of the image holding member; forming an electrostatic image on the charged surface of the image holding member; developing the electrostatic image formed on the surface of the image holding member with the electrostatic image developer according to the preceding exemplary embodiment to thereby form a toner image; transferring the toner image formed on the surface of the image holding member onto a recording medium; and fixing the toner image transferred onto the surface of the recording medium.

The image forming apparatus in the present exemplary embodiment may be applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including cleaning means for cleaning the surface of the image holding member after the transfer of the toner image but before charging; and an apparatus including charge eliminating means for eliminating charges on the surface of the image holding member after transfer of the toner image but before charging by irradiating the surface of the image holding member with charge eliminating light.

When the image forming apparatus in the present exemplary embodiment is the intermediate transfer-type apparatus, the transferring means includes, for example: an intermediate transfer body having a surface onto which a toner image is to be transferred; first transferring means for first-transferring a toner image formed on the surface of the image holding member onto the surface of the intermediate transfer body; and second transferring means for second-transferring the toner image transferred onto the surface of the intermediate transfer body onto the surface of a recording medium.

In the image forming apparatus in the present exemplary embodiment, for example, a portion including the developing means may have a cartridge structure (process cartridge) that is detachably attached to the image forming apparatus. The process cartridge used may be, for example, a process cartridge that includes the developing means containing the electrostatic image developer according to the preceding exemplary embodiment.

An example of the image forming apparatus in the present exemplary embodiment will be described, but this is not a limitation. In the following description, major components shown in FIG. 1 will be described, and description of other components will be omitted.

FIG. 1 is a schematic configuration diagram showing the image forming apparatus in the present exemplary embodiment.

The image forming apparatus shown in FIG. 1 includes first to fourth electrophotographic image forming units 10Y, 10M, 10C, and 10K (image forming means) that output yellow (Y), magenta (M), cyan (C), and black (K) images, respectively, based on color-separated image data. These image forming units (which may be hereinafter referred to simply as "units") 10Y, 10M, 10C, and 10K are arranged so as to be spaced apart from each other horizontally by a prescribed distance. These units 10Y, 10M, 10C, and 10K may each be a process cartridge detachable from the image forming apparatus.

An intermediate transfer belt (an example of the intermediate transfer body) 20 is disposed above the units 10Y, 10M, 10C, and 10K so as to extend through these units. The intermediate transfer belt 20 is wound around a driving roller 22 and a support roller 24 that are in contact with the inner surface of the intermediate transfer belt 20 and runs in a direction from the first unit 10Y toward the fourth unit 10K. A force is applied to the support roller 24 by, for example, an unillustrated spring in a direction away from the driving roller 22, so that a tension is applied to the intermediate transfer belt 20 wound around the rollers. An intermediate transfer belt cleaner 30 is disposed on an image holding surface of the intermediate transfer belt 20 so as to be opposed to the driving roller 22.

Yellow, magenta, cyan, and black toners contained in toner cartridges 8Y, 8M, 8C, and 8K, respectively, are supplied to developing devices (examples of the developing means) 4Y, 4M, 4C, and 4K, respectively, of the units 10Y, 10M, 10C, and 10K.

The first to fourth units 10Y, 10M, 10C, and 10K have the same structure and operate similarly. Therefore, the first unit 10Y that is disposed upstream in the running direction of the intermediate transfer belt and forms a yellow image will be described as a representative unit.

The first unit 10Y includes a photoconductor 1Y serving as an image holding member. A charging roller (an example of the charging means) 2Y, an exposure unit (an example of the electrostatic image forming means) 3, a developing device (an example of the developing means) 4Y, a first transfer roller 5Y (an example of the first transferring means), and a photoconductor cleaner (an example of image-holding member cleaning means) 6Y are disposed around the photoconductor 1Y in this order. The charging roller charges the surface of the photoconductor 1Y to a prescribed potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y. Bias power sources (not shown) for applying a first transfer bias are connected to the respective first transfer rollers 5Y, 5M, 5C, and 5K of the units. The bias power sources are controlled by an unillustrated controller to change the values of transfer biases applied to the respective first transfer rollers.

A yellow image formation operation in the first unit 10Y will be described.

First, before the operation, the surface of the photoconductor 1Y is charged by the charging roller 2Y to a potential of −600 V to −800 V.

The photoconductor 1Y is formed by stacking a photosensitive layer on a conductive substrate (with a volume resistivity of, for example, $1\times10^{-6}$ Ωcm or less at 20° C.). The photosensitive layer generally has a high resistance (the resistance of a general resin) but has the property that, when irradiated with a laser beam, the specific resistance of a portion irradiated with the laser beam is changed. Therefore, the charged surface of the photoconductor 1Y is irradiated with a laser beam 3Y from the exposure unit 3 according to yellow image data sent from an unillustrated controller. An electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is developed and visualized as a toner image by the developing device 4Y.

An electrostatic image developer containing, for example, at least a yellow toner and a carrier is contained in the developing device 4Y. The yellow toner is agitated in the developing device 4Y and thereby frictionally charged. The charged yellow toner has a charge with the same polarity (negative polarity) as the charge on the photoconductor 1Y and is held on a developer roller (an example of a developer holding member). As the surface of the photoconductor 1Y passes through the developing device 4Y, the yellow toner electrostatically adheres to charge-eliminated latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias applied in this case has a (+) polarity opposite to the (−) polarity of the toner and is controlled to, for example, +10 μA in the first unit 10Y by the controller (not shown). The toner remaining on the photoconductor 1Y is removed and collected by the photoconductor cleaner 6Y.

The first transfer biases applied to first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a secondary transfer portion that is composed of the intermediate transfer belt 20, the support roller 24 in contact with the inner surface of the intermediate transfer belt, and a secondary transfer roller (an example of the second transferring means) 26 disposed on the image holding surface side of the intermediate transfer belt 20. A recording paper sheet (an example of the recording medium) P is supplied to a gap between the secondary transfer roller 26 and the intermediate transfer belt 20 in contact with each other at a prescribed timing through a supply mechanism, and a secondary transfer bias is applied to the support roller 24. The transfer bias applied in this case has the same polarity (−) as the polarity (−) of the toner, and an electrostatic force directed from the intermediate transfer belt 20 toward the recording paper sheet P acts on the toner image, so that the toner image on the intermediate transfer belt 20 is transferred onto the recording paper sheet P. In this case, the secondary transfer bias is determined according to a resistance detected by resistance detection means (not shown) for detecting the resistance of the secondary transfer portion and is voltage-controlled.

Then the recording paper sheet P with the toner image transferred thereon is transported to a press contact portion (nip portion) of a pair of fixing rollers in a fixing device (an example of the fixing means) 28, and the toner image is fixed onto the recording paper sheet P to thereby form a fixed image. The recording paper sheet P with the color image fixed thereon is transported to an ejection portion, and a series of the color image formation operations is thereby completed.

Examples of the recording paper sheet P onto which a toner image is to be transferred include plain paper sheets used for electrophotographic copying machines, printers, etc. Examples of the recording medium include, in addition to the recording paper sheets P, transparencies. To further improve the smoothness of the surface of a fixed image, it may be necessary that the surface of the recording paper sheet P be smooth. For example, coated paper prepared by coating the surface of plain paper with, for example, a resin, art paper for printing, etc. are suitably used.

<Process Cartridge and Toner Cartridge>

A process cartridge according to an exemplary embodiment includes developing means that contains the electrostatic image developer according to the preceding exemplary embodiment and develops an electrostatic image formed on the surface of an image holding member with the electrostatic image developer to thereby form a toner image. The process cartridge is detachable from the image forming apparatus.

The process cartridge according to the present exemplary embodiment may include the developing means and at least one optional unit selected from other means such as an image holding member, charging means, electrostatic image forming means, and transferring means.

An example of the process cartridge according to the present exemplary embodiment will be shown, but this is not a limitation. In the following description, major components shown in FIG. 2 will be described, and description of other components will be omitted.

Figure 2:
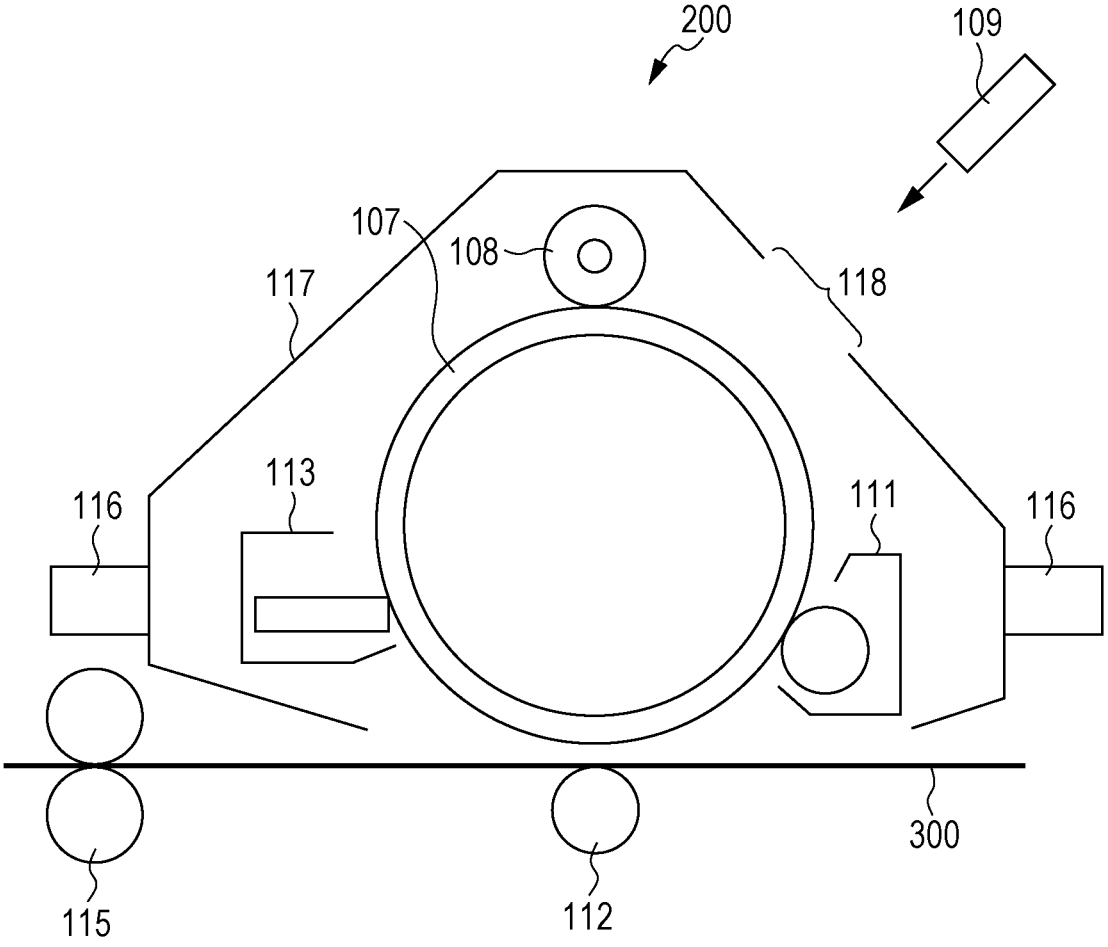
FIG. 2 is a schematic configuration diagram showing a process cartridge according to an exemplary embodiment.

FIG. 2 is a schematic configuration diagram showing an example of the process cartridge according to the present exemplary embodiment.

The process cartridge 200 shown in FIG. 2 includes, for example, a housing 117 including mounting rails 116 and an opening 118 for light exposure and further includes: a photoconductor 107 (an example of the image holding member); a charging roller 108 (an example of the charging means) disposed on the circumferential surface of the photoconductor 107; a developing device 111 (an example of the developing means); and a photoconductor cleaner 113 (an example of the cleaning means), which are integrally combined and held in the housing 117 to thereby form a cartridge.

In FIG. 2, 109 denotes an exposure unit (an example of the electrostatic image forming means), and 112 denotes a transferring device (an example of the transferring means). 115 denotes a fixing device (an example of the fixing means), and 300 denotes a recording paper sheet (an example of the recording medium).

Next, a toner cartridge according to an exemplary embodiment will be described.

The toner cartridge according to the present exemplary embodiment contains the toner according to the preceding exemplary embodiment and is detachably attached to the image forming apparatus. The toner cartridge contains a replenishment toner to be supplied to the developing means disposed in the image forming apparatus.

The image forming apparatus shown in FIG. 1 has a structure in which the toner cartridges 8Y, 8M, 8C, and 8K are detachably attached. The developing devices 4Y, 4M, 4C, and 4K are connected to their respective toner cartridges through unillustrated toner supply tubes. When the amount of the toner remaining in a toner cartridge is small, this toner cartridge is replaced.

EXAMPLES

Examples of the present disclosure will next be described. However, the present disclosure is not limited to these Examples. In the following description, "parts" and "%" are based on mass, unless otherwise specified.

L*, a*, b*, and the color difference ΔE from PANTONE 2935U are measured by the methods described above.

<Preparation of Resin Particle Dispersion>

[Preparation of Resin Particle Dispersion (1)]

A heat-dried two-neck flask is charged with 10 parts by mole of polyoxyethylene(2,0)-2,2-bis(4-hydroxyphenyl) propane, 90 parts by mole of polyoxypropylene(2,2)-2,2-bis (4-hydroxyphenyl)propane, 10 parts by mole of terephthalic acid, 67 parts by mole of fumaric acid, 3 parts by mole of n-dodecenyl succinic acid, 20 parts by mole of trimellitic acid, and 0.05 parts by mole of dibutyl tin oxide. Nitrogen gas is introduced into the flask, and the flask is heated while the inert atmosphere is maintained. While the temperature is maintained at from 150° C. to 230° C. inclusive, the mixture is subjected to a co-condensation polymerization reaction for 15 hour. Then, while the temperature is maintained at from 210° C. to 250° C. inclusive, the pressure is gradually reduced to thereby synthesize a polyester resin (1). The polyester resin (1) has a weight average molecular weight Mw of 130,000 and a glass transition temperature Tg of 73° C.

An emulsification tank of a high-temperature high-pressure emulsification apparatus (CAVITRON CD1010, slit: 0.4 mm) is charged with 3,000 parts of the polyester resin (1) obtained, 10,000 parts of ion exchanged water, and 90 parts of a surfactant (sodium dodecylbenzene sulfonate), and the mixture is melted under heating at 130° C., dispersed at 110° C., a flow rate of 3 L/minute, and 10,000 rpm for 30 minutes, and caused to pass through a cooling tank to collect a resin particle dispersion. A resin particle dispersion (1) is obtained in the manner described above.

[Preparation of Resin Particle Dispersion (2)]

A heat-dried three-neck flask is charged with 44 parts by mole of 1,9-nonanediol, 56 parts by mole of dodecanedicarboxylic acid, and 0.05 parts by mole of dibutyl tin oxide serving as a catalyst. The air in the flask is replaced with nitrogen gas by a pressure reducing operation, and the mixture in the inert atmosphere is mechanically stirred at 180° C. for 2 hours. Then the mixture is gradually heated to 230° C. under reduced pressure and stirred for 5 hours. When the mixture turns viscous, the mixture is air-cooled to stop the reaction, and a polyester resin (2) is thereby synthesized. The polyester resin (2) has a weight average molecular weight Mw of 27,000 and a melting temperature Tm of 72° C. Then a resin particle dispersion (2) is obtained using the high-temperature high-pressure emulsification apparatus (CAVITRON CD1010, slit: 0.4 mm) under the same conditions as in the production of the resin particle dispersion (1) except that the polyester resin (2) is used instead of the polyester resin (1).

[Preparation of Resin Particle Dispersion (3)]

200 Parts of styrene, 50 parts of n-butyl acrylate, and 5 parts of dodecanethiol are mixed and dissolved, and the mixture is subjected to emulsion polymerization in a flask containing a solution prepared by dissolving 5 parts of an anionic surfactant (NEOGEN RK manufactured by DAI-ICHI KOGYO SEIYAKU Co., Ltd.) in 750 parts of ion exchanged water. The resulting mixture is gently stirred for 60 minutes, and 60 parts of ion exchanged water containing 6 parts of ammonium persulfate dissolved therein is added to the mixture. After nitrogen purging, the contents of the flask are heated to 80° C. in an oil bath under stirring, and the emulsion polymerization is continued for 6 hours. Then the mixture is cooled, and a resin particle dispersion (3) is thereby obtained.

<Preparation of Coloring Agent Dispersion>

[Preparation of Magenta Pigment Dispersion M1]

C.I. Pigment Red 238 (naphthol-based pigment manufactured by SANYO COLOR WORKS, Ltd.): 25 parts Anionic surfactant (NEOGEN RK manufactured by DAI-ICHI KOGYO SEIYAKU Co., Ltd.): 2 parts Ion exchanged water: 125 parts The above components are mixed and dispersed for one hour using a high-pressure impact disperser Ultimaizer (HJP30006 manufactured by Sugino Machine Limited) to thereby prepare a magenta pigment dispersion containing the magenta pigment dispersed therein. The magenta pigment in the magenta pigment dispersion has a volume average particle diameter of 0.12 μm, and the concentration of the pigment particles is 24% by mass.

[Preparation of Magenta Pigment Dispersion M2]

A magenta pigment dispersion M2 is produced in the same manner as in the production of the magenta pigment dispersion M1 except that the magenta pigment used is changed to C.I. Pigment Red 122 (quinacridone-based pigment, manufactured by DIC Corporation).

[Preparation of Cyan Pigment Dispersion C1]

C.I. Pigment Blue 15:3 (copper phthalocyanine-based pigment manufactured by DIC Corporation): 25 parts Anionic surfactant (NEOGEN RK manufactured by DAI-ICHI KOGYO SEIYAKU Co., Ltd.): 2 parts Ion exchanged water: 125 parts The above components are mixed and dispersed for one hour using a high-pressure impact disperser Ultimaizer (HJP30006 manufactured by Sugino Machine Limited) to thereby prepare a cyan pigment dispersion containing the cyan pigment dispersed therein. The cyan pigment in the cyan pigment dispersion has a volume average particle diameter of 0.12 μm, and the concentration of the cyan pigment particles is 24% by mass.

[Preparation of Cyan Pigment Dispersion C2]

A cyan pigment dispersion C2 is produced in the same manner as in the production of the cyan pigment dispersion C1 except that the cyan pigment used is changed to C.I. Pigment Blue 16 (phthalocyanine pigment).

<Preparation of release agent dispersion>

Paraffin wax (HNP0190 manufactured by Nippon Seiro Co., Ltd.): 100 parts

Anionic surfactant (NEWREX R manufactured by NOF CORPORATION): 2 parts

Ion exchanged water: 300 parts

The above components are heated to 95° C., dispersed using a homogenizer (ULTRA-TURRAX T50 manufactured by IKA), and subjected to dispersion treatment using a pressure ejection-type Gaulin homogenizer (manufactured by Gaulin Corporation) to thereby prepare a release agent dispersion (release agent concentration: 20% by mass) containing dispersed therein the release agent with a volume average particle diameter of 200 nm.

Examples 1 to 10 and Comparative Examples 1 and 2

<Production of Toner Particles 1 to 12>

[Production of Toner Particles 1 to 8]

Resin particle dispersion (1): 300 parts

Resin particle dispersion (2): amount shown as solid content in Table 1

Magenta pigment dispersion: amount shown as solid content in Table 1

Cyan pigment dispersion: amount shown as solid content in Table 1

Release agent dispersion: 37 parts

Ion exchanged water: 350 parts

Anionic surfactant (TaycaPower manufactured by Tayca Corporation): 3 parts

The above materials are placed in a stainless steel-made round bottom flask. 0.1N (mol/L) nitric acid is added thereto to adjust the pH to 3.5, and 5 parts of an aqueous nitric acid solution with a polyaluminum chloride concentration of 10% by mass is added. Next, the mixture is dispersed at a solution temperature of 30° C. using a homogenizer (ULTRA-TURRAX T50 manufactured by IKA), and the resulting mixture is heated to 45° C. in a heating oil bath at a rate of 1° C. per 30 minutes and held at 45° C. for 30 minutes. Then 50 parts of the polyester resin particle dispersion (1) is further added, and the mixture is held for 1 hour. Then a 0.1N (mol/L) aqueous sodium hydroxide solution is added to adjust the pH to 8.5, and the resulting mixture is heated to 84° C. and held for 2.5 hours. Next, the mixture is cooled to 20° C. at a rate of 20° C./minute, filtrated, sufficiently washed with ion exchanged water, and dried. Toner particles 1 to 8 are obtained in the manner described above.

1.5 Parts by mass of hydrophobic silica (RY50 manufactured by Nippon Aerosil Co., Ltd.) and 1.0 part by mass of hydrophobic titanium oxide (T805 manufactured by Nippon Aerosil Co., Ltd.) are mixed with 100 parts by mass of toner particles, and the mixture is stirred at 10,000 rpm for 30 second using a sample mill. The resulting mixture is sieved using a vibrating sieve with a mesh size of 45 μm. Toners 1 to 8 (toners for electrostatic image development) are prepared in the manner described above. The volume average particle diameters of the toners obtained are shown in Table 1.

—Production of Electrostatic Image Developers—

8 Parts of a toner and 92 parts of a carrier are mixed using a V blender to produce a developer (electrostatic image developer).

The toners for electrostatic image development and electrostatic image developers obtained in Examples 1 to 10 and Comparative Examples 1 and 2 are used to perform the following evaluation. The results of the evaluation are summarized in Table 2.

[Evaluation]

<Evaluation Image>

A printer prepared by modifying ApeosPort-II4300 manufactured by Fuji Xerox Co., Ltd. is used to output an unfixed image of Test Chart No. 1-R 1993 available from the Imaging Society of Japan. White paper sheets (paper thickness: 88 μm, basis weight: 64 g/m$^2$) are used, and the print conditions are set such that the toner mass per unit area in a square patch at the center is 4.0 g/m$^2$. Next, a fixing unit used in the ApeosPort-II4300 is removed and replaced with a fixing unit modified such that the fixing unit can be externally driven and its temperature can be controlled. This fixing unit is used to fix the unfixed image under the driving conditions of a fixing rate of 200 mm/sec and a fixing member surface temperature of 160° C. at the time of insertion of the paper sheet. Then the color of the fixed image is measured using X-rite 938 (manufactured by X-rite).

<Evaluation of Outdoor Visibility>

The lighting of an evaluation room is controlled such that the illuminance is 100,000 lx (the illuminance in the open air in fine weather), and the visibility of the image of the Test Chart No. 1-R 1993 available from the Imaging Society of Japan is evaluated.

The evaluation criteria are as follows.

A: No light reflection is observed, and the image can be clearly seen.

B: Slight light reflection is observed, but the image can be seen without any problem.

C: Light reflection is observed, but the entire image can be seen, although hard to see.

D: Part of the image cannot be seen because of light reflection.

<Evaluation of Outdoor Fine-Line Visibility>

A surface property tester TriboGear 14DR (manufactured by Shinto Scientific Co., Ltd.) is used to test the visibility of smallest alphabet characters (4 pt) in the image of the Test Chart No. 1-R 1993 available from the Imaging Society of Japan. An unused white paper sheet (paper thickness: 88 μm, basis weight: 64 g/m$^2$) is placed on the image, and the surface of the fixed image is rubbed back and forth 10 times at a vertical load of 100 g and a rubbing rate of 10 mm/sec with a rubbing stroke of 5 cm. Then the lighting of the evaluation room is controlled such that the illuminance is 100,000 lx (the illuminance in the open air in fine weather), and the visibility of the rubbed smallest alphabet characters is evaluated.

The evaluation criteria are as follows.

A: All the alphabet characters are readable.

B: The number of unreadable alphabet characters is from 1 to 3 inclusive.

C: The number of unreadable alphabet characters is from 4 to 7 inclusive.

D: The number of unreadable alphabet characters is 8 or more.

TABLE 1

| | Magenta pigment dispersion | | Cyan pigment dispersion | | | Volume average | Binder resin | |
|---|---|---|---|---|---|---|---|---|
| | Type | Content $W^M$ (% by mass) | Type | Content $W^C$ (% by mass) | $W^M/W^C$ | particle diameter (μm) | Type of amorphous resin | Amount of crystalline resin (parts by mass) |
| Toner 1 | M1 | 2.52 | C1 | 3.58 | 0.70 | 6.0 | Resin particle dispersion (1) | 7.0 |
| Toner 2 | M1 | 1.80 | C1 | 4.13 | 0.44 | 6.0 | Resin particle dispersion (1) | 7.0 |
| Toner 3 | M1 | 3.24 | C1 | 3.03 | 1.07 | 6.0 | Resin particle dispersion (1) | 7.0 |
| Toner 4 | M1 | 2.52 | C1 | 3.58 | 0.70 | 3.7 | Resin particle dispersion (1) | 7.0 |
| Toner 5 | M1 | 2.52 | C1 | 3.58 | 0.70 | 7.8 | Resin particle dispersion (1) | 7.0 |
| Toner 6 | M1 | 2.52 | C1 | 3.58 | 0.70 | 6.0 | Resin particle dispersion (1) | 2.5 |
| Toner 7 | M2 | 2.52 | C1 | 3.58 | 0.70 | 6.0 | Resin particle dispersion (1) | 7.0 |
| Toner 8 | M1 | 2.52 | C2 | 3.58 | 0.70 | 6.0 | Resin particle dispersion (1) | 7.0 |
| Toner 9 | M1 | 2.52 | C1 | 3.58 | 0.70 | 6.0 | Resin particle dispersion (3) | 7.0 |
| Toner 10 | M1 | 2.52 | C1 | 3.58 | 0.70 | 6.0 | Resin particle dispersion (1) | 0 |
| Toner 11 | M1 | 1.44 | C1 | 4.40 | 0.33 | 6.0 | Resin particle dispersion (1) | 7.0 |
| Toner 12 | M1 | 3.53 | C1 | 2.81 | 1.26 | 6.0 | Resin particle dispersion (1) | 7.0 |

TABLE 2

| | Toner | L* | a* | b* | Difference in color from PANTONE 2935U ΔE | Outdoor visibility | Outdoor fine-line visibility |
|---|---|---|---|---|---|---|---|
| Example 1 | Toner 1 | 40.8 | −0.9 | −44.9 | 1.6 | A | A |
| Example 2 | Toner 2 | 42.3 | −8.7 | −47.7 | 9.1 | C | C |
| Example 3 | Toner 3 | 40.0 | 6.2 | −41.4 | 7.7 | C | C |
| Example 4 | Toner 4 | 40.4 | −1.3 | −45.1 | 1.6 | A | C |
| Example 5 | Toner 5 | 40.1 | 0.0 | −44.1 | 1.9 | A | C |
| Example 6 | Toner 6 | 41.3 | −0.9 | −44.7 | 2.0 | A | C |
| Example 7 | Toner 7 | 41.9 | −3.9 | −48.8 | 5.2 | B | B |
| Example 8 | Toner 8 | 40.9 | −3.8 | −42.5 | 5.2 | B | B |
| Example 9 | Toner 9 | 40.8 | −0.9 | −44.9 | 1.6 | A | A |
| Example 10 | Toner 10 | 40.9 | −0.8 | −44.8 | 1.7 | A | C |
| Comparative Example 1 | Toner 11 | 43.3 | −12.9 | −49.0 | 13.7 | D | D |
| Comparative Example 2 | Toner 12 | 39.5 | 9.0 | −39.9 | 10.8 | D | D |

As can be seen from the results shown in Table 2, with the toners for electrostatic image development in the Examples, the outdoor visibility of the images obtained is better than that with the toners for electrostatic image development in the Comparative Examples.

As can be seen from the results shown in Table 2, the toners for electrostatic image development in the Examples can form images with excellent outdoor fine-line visibility.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for electrostatic image development, comprising:

a binder resin; and a coloring agent, wherein, when an image with a toner mass per unit area of 4.0 g/m$^2$ is formed using the toner, the image has a color that satisfies the following conditions (A), (B), and (C):

(A) L* is from 37 to 50 inclusive;

(B) a* is from −12 to 8 inclusive; and (C) b* is from −49 to −40 inclusive, the coloring agent contains a cyan pigment and a magenta pigment, and a mass ratio ($W^M/W^C$) of a content $W^M$ of the magenta pigment in the toner to a content $W^C$ of the cyan pigment in the toner is from 0.40 to 1.10 inclusive.

2. The toner for electrostatic image development according to claim 1, wherein a color difference ΔE between the image with a toner mass per unit area of 4.0 g/m$^2$ and PANTONE 2935U used as a color sample is 10 or less.

3. The toner for electrostatic image development according to claim 1, wherein the binder resin contains a crystalline resin.

4. The toner for electrostatic image development according to claim 3, wherein a content of the crystalline resin is from 2% by mass to 30% by mass inclusive based on a total mass of the binder resin.

5. The toner for electrostatic image development according to claim 1, wherein the toner has a volume average particle diameter of 3.5 μm or more and less than 8.0 μm.

6. The toner for electrostatic image development according to claim 1, wherein the cyan pigment contains a copper phthalocyanine-based pigment.

7. The toner for electrostatic image development according to claim 1, wherein the magenta pigment contains at least one pigment selected from the group consisting of quinacridone-based pigments, carmine-based pigments, and naphthol-based pigments.

8. The toner for electrostatic image development according to claim 1, wherein the mass ratio ($W^M/W^C$) is from 0.50 to 0.00 inclusive.

9. The toner for electrostatic image development according to claim 1, wherein the toner particles are core-shell particles.

10. An electrostatic image developer comprising the toner, for electrostatic image development, according to claim 1.

11. A toner cartridge comprising the toner, for electrostatic image development, according to claim 1, the toner being housed in the toner cartridge, the toner cartridge being detachably attached to an image forming apparatus.

12. The toner for electrostatic image development according to claim 1, wherein the mass ratio ($W^M/W^C$) is from 0.55 to 0.85 inclusive.

13. The toner for electrostatic image development according to claim 1, wherein the mass ratio ($W^M/W^C$) is from 0.60 to 0.80 inclusive.

14. The toner for electrostatic image development according to claim 1, wherein a content of the coloring agent is from 1% by mass to 30% by mass inclusive based on a total mass of the toner.

15. The toner for electrostatic image development according to claim 1, wherein a content of the coloring agent is from 3% by mass to 15% by mass inclusive based on a total mass of the toner.

16. The toner for electrostatic image development according to claim 15, wherein a total content of the cyan pigment and the magenta pigment combined is 80% by mass to 100% by mass of the coloring agent.

17. The toner for electrostatic image development according to claim 1, wherein a content of the cyan pigment and the magenta pigment is 80% by mass to 100% by mass of the coloring agent.

18. The toner for electrostatic image development according to claim 1, wherein a total content of the cyan pigment and the magenta pigment combined is 90% by mass to 100% by mass of the coloring agent.

19. The toner for electrostatic image development according to claim 1, wherein a total content of the cyan pigment and the magenta pigment combined is 100% by mass of the coloring agent.

* * * * *